US006071199A

United States Patent [19]

Suzuki

[11] Patent Number: 6,071,199

[45] **Date of Patent: *Jun. 6, 2000**

[54] METHOD OF CORRECTION OF GOLF SWING

[76] Inventor: Tokio Suzuki, 2809-2, Nara-machi, Aoba-ku, Yokohama-shi, Kanagawa-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/967,902

[22] Filed: Nov. 12, 1997

[30] Foreign Application Priority Data

Nov. 15, 1996 [JP] Japan ..... 8-321028

[51] Int. Cl.[7] ..... A63B 53/14; A63B 53/16

[52] U.S. Cl. ..... 473/294; 473/299; 473/409

[58] Field of Search ..... 473/294, 298, 473/299, 212, 409, 206, 226, 551

[56] References Cited

U.S. PATENT DOCUMENTS

| | | | |
|---|---|---|---|
| 760,161 | 5/1904 | Smith | 473/294 |
| 1,919,221 | 7/1933 | Janes | 473/294 |
| 3,794,279 | 2/1974 | Kramer | 248/523 |
| 4,754,978 | 7/1988 | Dworacek | 473/294 |
| 4,878,673 | 11/1989 | Pollard | 473/409 |
| 5,037,103 | 8/1991 | Williams | 473/294 |
| 5,388,834 | 2/1995 | Dawson | 473/211 |
| 5,518,235 | 5/1996 | Mendenhall | 473/314 |

*Primary Examiner*—Jeanette Chapman
*Assistant Examiner*—Stephen L. Blau
*Attorney, Agent, or Firm*—Kanesaka & Takeuchi

[57] ABSTRACT

In order to correct a golf swing, a main grip formed at an end portion of a shaft of a golf club is held by a hand opposite to a writing hand of a user, and an auxiliary grip attached to a middle of the shaft is held by the writing hand of the user. While holding the main and auxiliary grips by the left and right hands, the shaft is swung. The auxiliary grip is located near and substantially parallel to the main grip and is disposed at a side ahead of the main grip in a swinging direction of the golf club to be spaced from the main grip for a predetermined space. Thus, when the main and auxiliary grips are grasped by left and right hands, the backs of the left and right hands contact each other between the main and auxiliary grips to restrain a wrist of the writing hand by the back of the hand opposite to the writing hand. Accordingly, the correct swing of the golf club can be practiced.

6 Claims, 9 Drawing Sheets

A

B

A

B

METHOD OF CORRECTION OF GOLF SWING

BACKGROUND OF THE INVENTION

1. Field of the Invention

This invention relates to a method of correction of a golf swing, and in particular the method is used in order to strike a golf ball properly on exercise for a correction of error swing.

2. Description of the Related Art

When golf is played, a golf ball is struck by a head of a club, and the ball is thereby propelled in a predetermined direction or to a predetermined position.

In an ordinary golf club, a head is fitted to one end of a shaft, and a grip is provided in the other end or a part of the base. Various types of clubs may be used depending on the position where the ball is to be struck, the situation and the distance it is required to propel the ball, such as drivers, spoons, irons and putters.

When the player prepares to strike the ball with the club, he first grasps a grip on the club with the left hand if he is right-handed, and places his right hand over the left hand so as to steady his hold on the grip. In other words, conventionally, a single grip was grasped by both the left and right hands, and the club was grasped with the right hand on the outside.

In such a grip, the wrist of the right hand has no restriction and is free. Therefore, the wrist of the right hand easily moves and flexes, and if this occurs, the golf ball is struck with a jolt. When the wrist of the right hand moves, the right shoulder descends. If the ball is struck in this way, the right shoulder does not rotate smoothly, and a correct swing cannot be performed.

OBJECTS AND SUMMARY OF THE INVENTION

It is therefore an object of this invention to provide a method of correction of a golf swing, which; allows a correct swing to be performed, the writing hand being the hand usually used by a player to write with a pen.

It is another object of this invention to provide a method of correction of a golf swing, wherein a; golf club has separate grips which can be grasped by the left and right hands respectively.

A further object of this invention is to provide a method of correction of a golf swing, which brings the backs of the left and right hands in contact so that the motion of the left and right wrists is restricted, and prevents the left and right wrists from moving so that the left and right shoulders droop or sag.

A still further object of this invention is to provide a method of correction of a golf swing, wherein the grips can be grasped by crossing over hands.

A still further object of this invention is to provide a method of correction of a golf swing, wherein a golf club can be held such that the wrist of a writing hand grasping an auxiliary grip, can be pressed by the other hand grasping a main grip so that the wrist of the writing hand is restrained.

A still further object of this invention is to provide a method of correction of a golf swing, wherein a golf club can be held such that a swing is substantially performed by a hand holding the main grip, and the motion of the other hand holding the auxiliary grip is restricted by the hand on the main grip.

According to one aspect of this invention, a golf club comprising a pair of grips is used wherein, when a player grasps these grips respectively with his left and right hands, the backs of his hands come in contact. The golf club referred to herein may be any type of golf club such as a driver, spoon, iron or putter. In the golf club according to this invention, the backs of the player's hands come in contact. The wrist of the writing hand is thereby pressed by the other hand so that the motion of the wrist of the writing hand is restrained.

In this invention, the writing hand means a hand to write usually with a pen, namely the writing hand is right hand when he is right-handed and left hand when he is left-handed.

The above and other objects, features and advantages of the invention will be apparent from the following description of illustrative embodiments, which are to be read in connection with accompanying drawings.

DETAILED DESCRIPTION OF THE PREFERRED EMBODIMENTS

Figure 1:
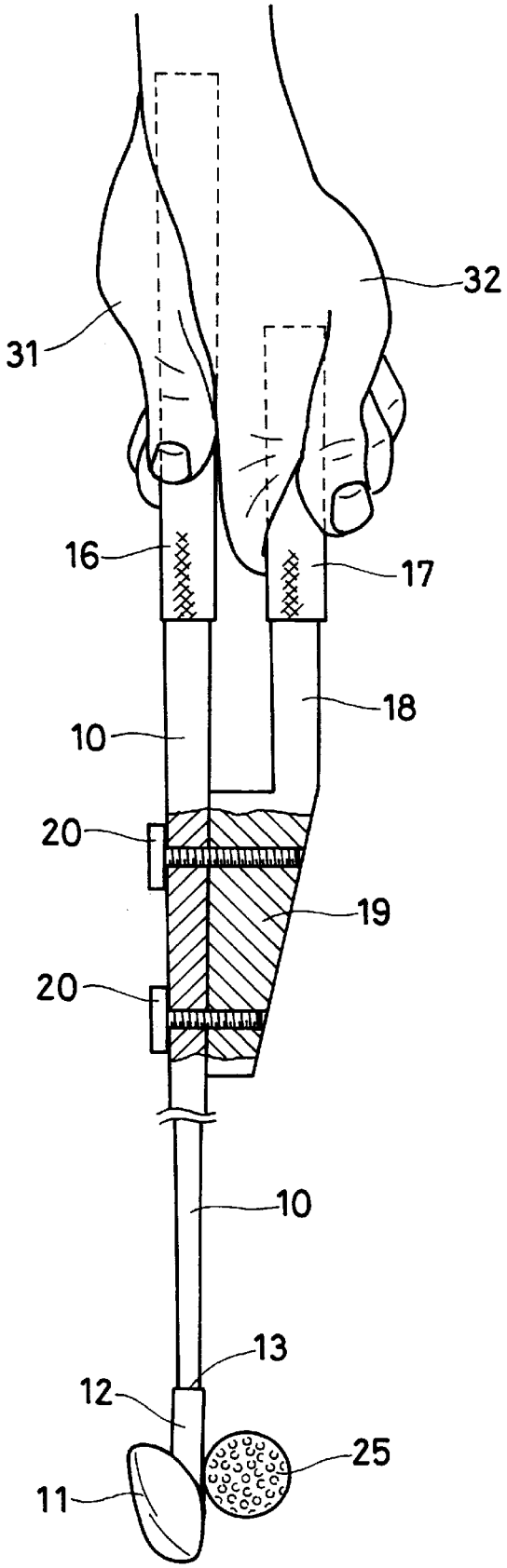
FIG. 1 is a front view of a golf club used in the invention.
Figure 2:
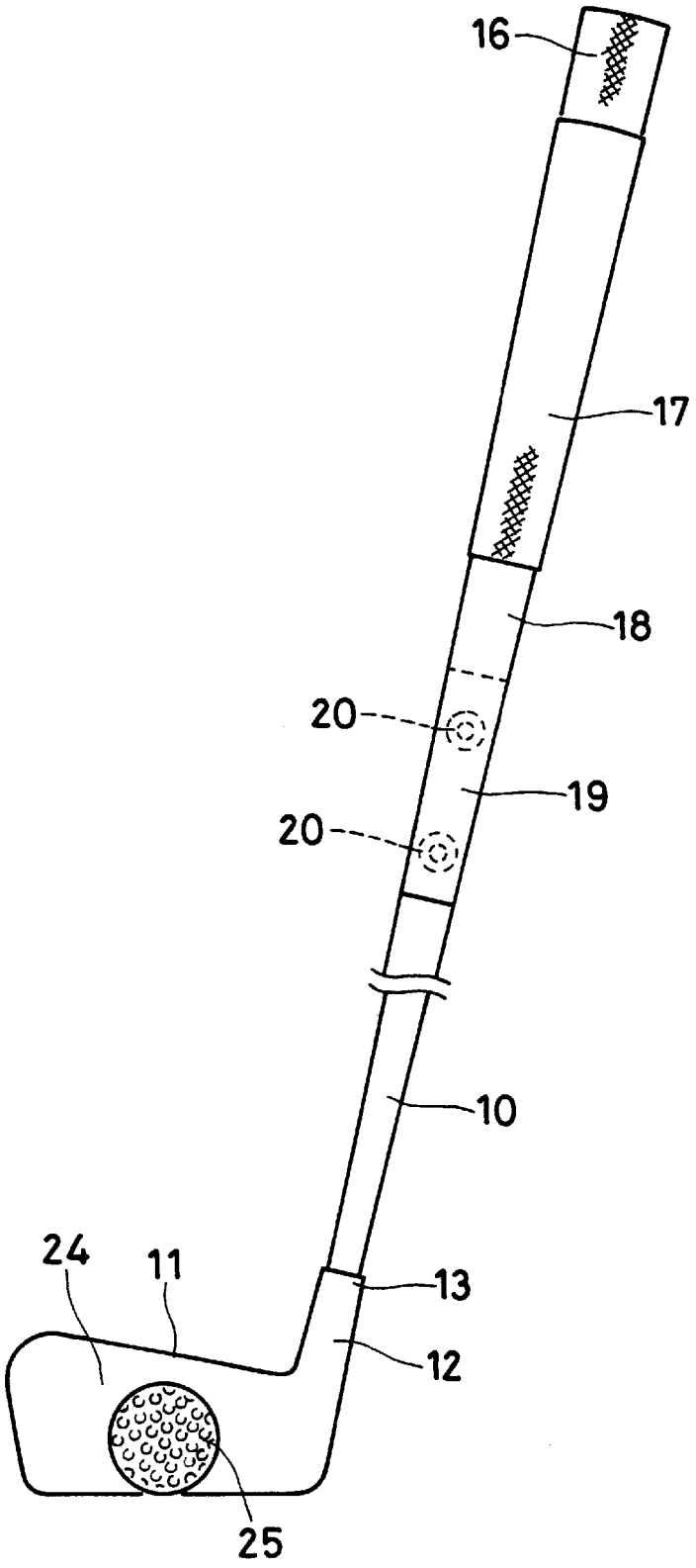
FIG. 2 is a lateral view of a golf club shown in FIG. 1.
Figure 3:
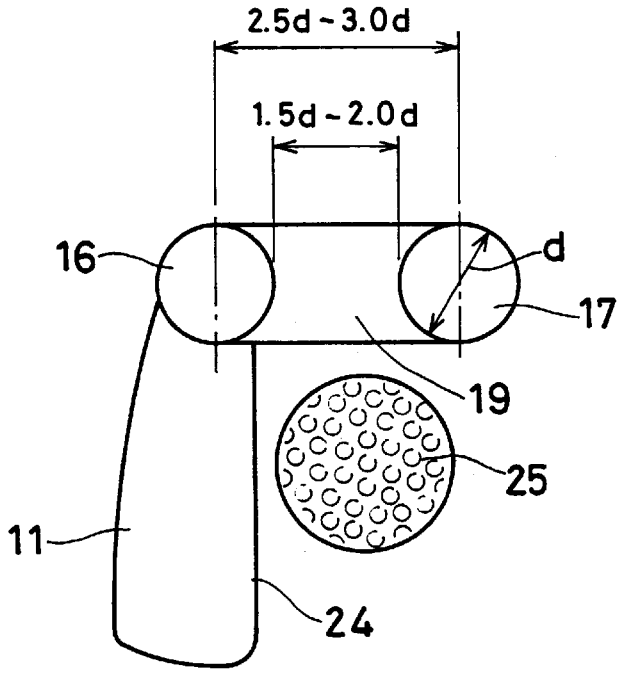
FIG. 3 is a plan view of a golf club shown in FIG. 1.

FIG. 1 to FIG. 3 show a golf club according to a first embodiment of this invention. The golf club comprises a tapering shaft 10, this shaft 10 being comprised of metal or fiber-reinforced resin. A head 11 is attached to the tapering top end of the shaft 10. The head 11 may be comprised of iron, steel, brass, light alloy or other metals, organic materials or inorganic materials. The end of a neck 12 of the head 11 is hollow, and the tip of the shaft 10 is inserted in and joined to a hollow joint 13.

A main grip 16 is attached to the opposite end of the shaft 10, and an auxiliary grip 17 is disposed substantially parallel to this main grip 16. The auxiliary grip 17 is attached to one end of an auxiliary shaft 18, and a joining block 19 is provided in a one-piece construction at the other end of this auxiliary shaft 18. The joining block 19 is attached to the shaft 10 via fixing members 20.

The positions of the main grip 16 and auxiliary grip 17 in the height direction are staggered with respect to each other as shown in FIG. 1, i.e. the main grip 16 is at a high position whereas the auxiliary grip 17 is in a relatively low position.

It is desirable that when the club is used by a man of usual stature, the upper end of the auxiliary grip 17 is approximately 12–15 cm lower than the upper end of the main grip 16.

As shown in FIG. 3, for example, the auxiliary grip 17 fitted to the shaft 10 is substantially at right angles to the extending direction of the head 11 relative to the shaft 10, or to the lower edge of a front surface 24 of the head 11, and is offset relative to the main grip 16 in the line of swing of the club. The spacing between these two grips 16, 17 may be 1.5–2 times greater than the diameter "d" of the grips 16, 17 as shown in FIG. 3. This value is such that the center-to-center distance between the grips 16, 17 is 2.5–3.0 times greater than the diameter of the grips 16, 17.

The main grip 16 is grasped by the left hand 31 which is opposite to the writing hand, and the auxiliary grip 17 is grasped by the right hand, which is the writing hand. FIG. 1–FIG. 3 show a club for a right-handed player. For a left-handed player, the club is formed in the mirror image of that shown in FIG. 1. In this latter case, the main grip 16 is grasped by the right hand 32, and the auxiliary grip 17 is grasped by the left hand. Hence, a golf ball 25 may be struck by the head 11 by grasping the main grip 16 and auxiliary grip 17 with the left and right hands 31, 32 as described hereabove, and swinging the club.

Figure 4:
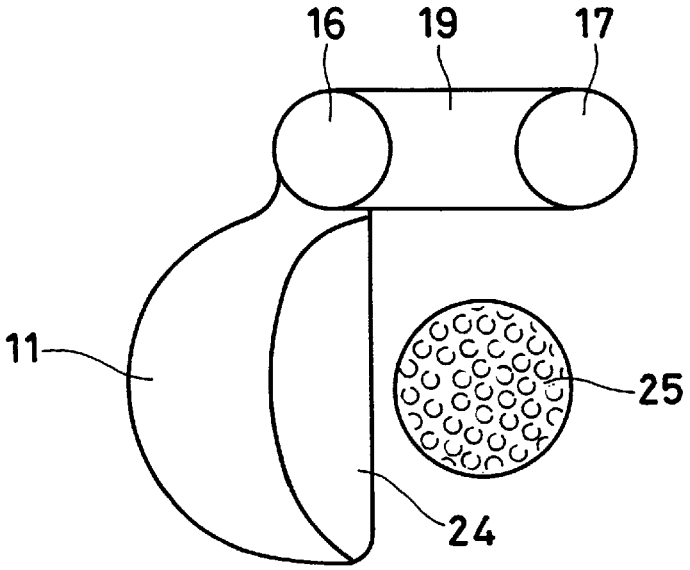
FIG. 4 is a plan view of a golf club according to a modification.

FIG. 4 shows a modification of the above embodiment. According to this modification, the construction is applied to a driver. In a driver club, the main grip 16 and auxiliary grip 17 are also disposed at a predetermined interval apart in the line of swing. Specifically, the auxiliary grip 17 is at right angles to the fixing direction of the head 11 and offset in the line of swing relative to the shaft to which the main grip 16 is attached.

The golf club according to this embodiment therefore comprises the auxiliary grip 17 in addition to the main grip 16, the main grip 16 and auxiliary grip 17 being grasped separately and respectively by the left and right hands. In this regard, one point that should be noted is that, as is clear from FIG. 1, these grips are so disposed that the backs of the hands 31, 32 touch each other. Specifically, as the center-to-center distance between the main grip 16 and auxiliary grip 17 is within a range of 2.5–3.0 times greater than the diameter of the grips 16, 17, the backs of the left and right hands 31, 32 touch each other lightly when the main grip 16 and auxiliary grip 17 are held respectively by the left hand 31 and right hand 32. In this arrangement, the back of the left hand 31 comes in contact with the wrist of the right hand 32, which is the writing hand, so as to restrain it.

According to this arrangement, the wrist of the right hand 32 is restrained by the back of the left hand 31 so that it is effectively immobilized. Due to this fact, the wrist of the right hand 32 cannot turn around by twisting when the swing is performed. Further, as the wrist of the right hand 32 is immobilized by the back of the left hand, the swing is no longer performed with the right shoulder sagging. The head 11 of the club is therefore prevented from striking the ground instead of the ball during the swing. Such a mistake is usually referred to as a "duff", meaning that the player misses the golf ball 25 so that the ball does not propel forward.

According to this embodiment, therefore, "duffs" are prevented, and it is easy to perform a correct swing wherein the head 11 strikes the ball 25. Also as the wrist of the right hand is restrained, the right shoulder is prevented from sagging, therefore gyration of the left and right shoulders is enhanced and the distance traveled by the ball 25 increases.

In the above description, the example of a right-handed player was taken. In the case of a left-handed player, the club is formed in a mirror image of the club shown in FIG. 1. The swing is then performed with the wrist of the left hand 31 being restrained by the back of the right hand 32, the same effect being obtained as that of the aforesaid embodiment.

Figure 5:
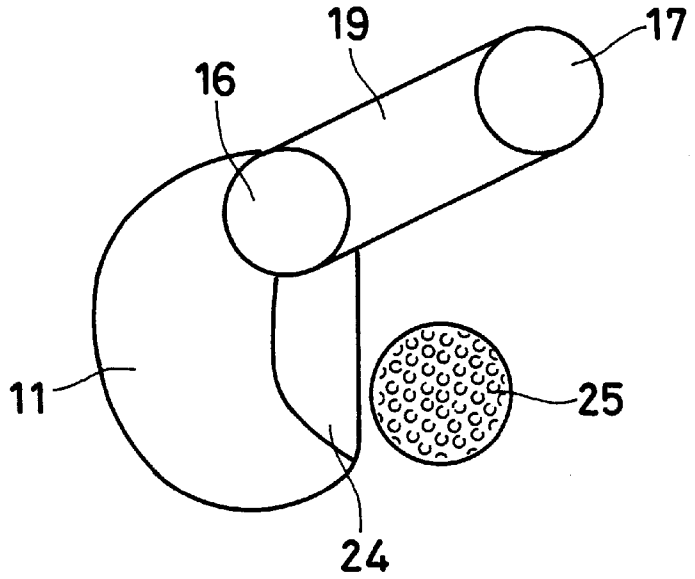
FIGS. 5A and 5B are plan views of a golf club having an auxiliary grip offset closer to or further from a player's body than a main grip when the club is held by the player.
Figure 5:
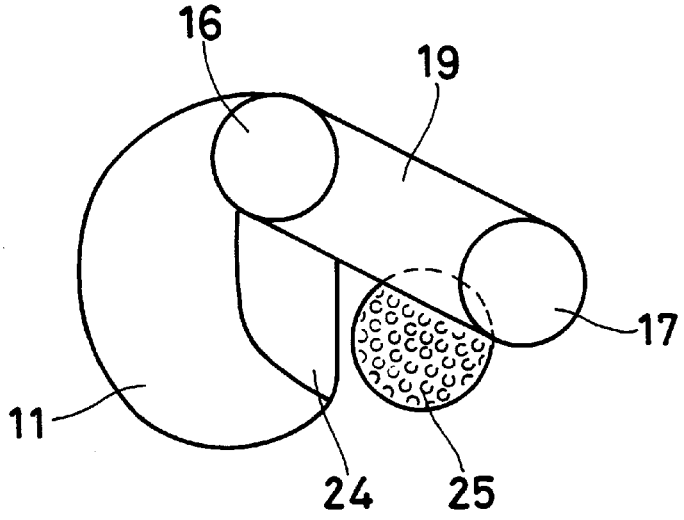
Figure 6:
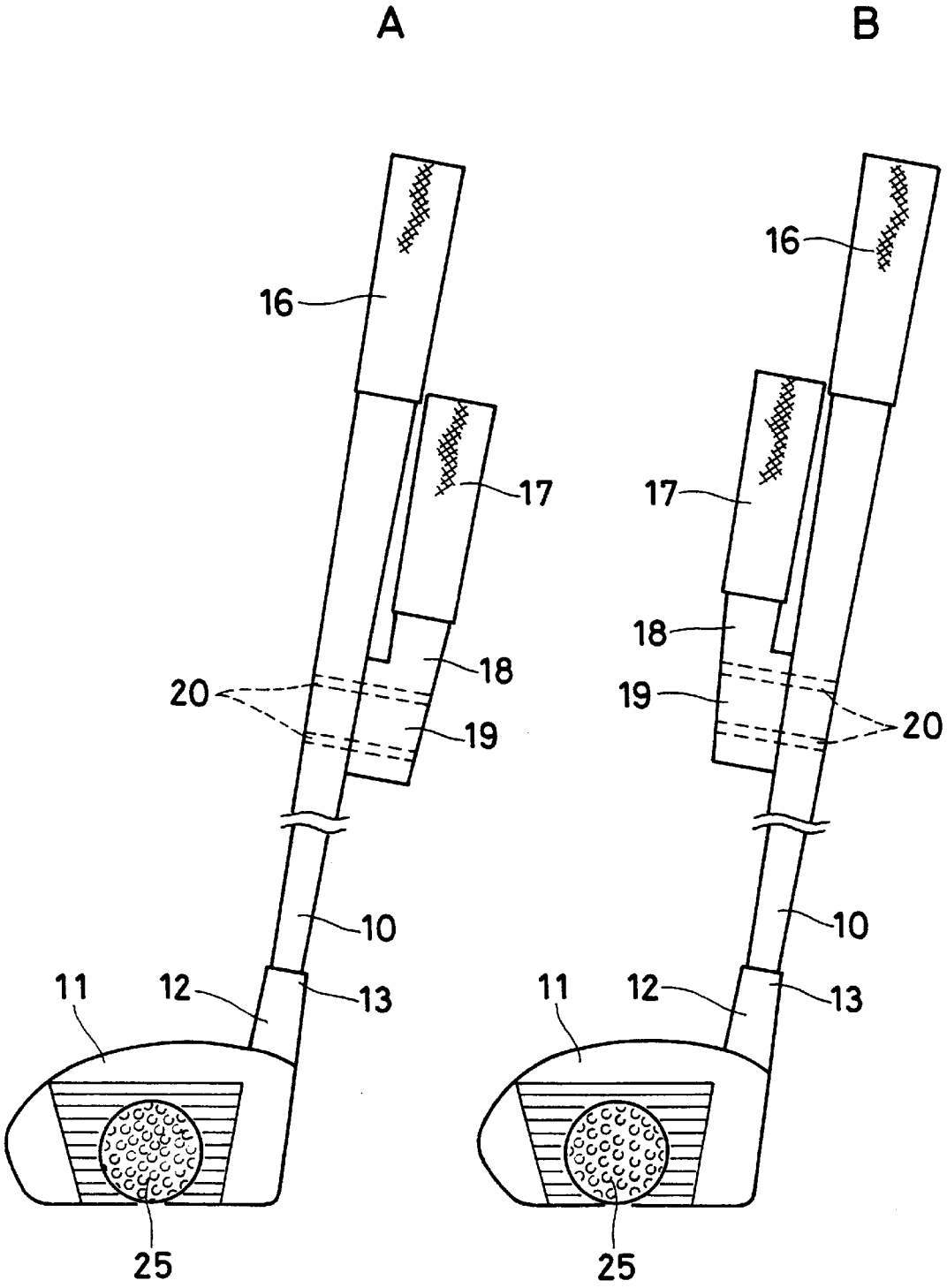
FIGS. 6A and 6B are lateral views of a golf club having an auxiliary grip offset closer to or further from a player's body than an main grip when the club is held by the player.

The main grip 16 and the auxiliary grip 17 do not necessarily have to be disposed in the line of swing, it being sufficient if the auxiliary grip 17 is disposed such that it is offset closer to or further from the player's body than the main grip 16. FIGS. 5A and 6A show the case where the auxiliary grip 17 is offset closer to the player's body than the main grip 16 in the line of swing, i.e. offset in the opposite direction to that in which the head 11 extends.

By offsetting the auxiliary grip 17 in front of the main grip 16 and closer to the player's body, the right hand which is the writing hand tends to bend around the left hand, and gyration of the right shoulder is therefore enhanced. This makes the right shoulder tend to droop slightly, so such an arrangement can easily result in a slice ball. However this may help to correct the swing of players who tend to play a hook ball.

On hand, in FIGS. 5B and 6B, the auxiliary grip 17 is offset further from the player's body than the main grip 16 in the line of swing, i.e. offset in the direction in which the head 11 extends. According to this arrangement, the left hand holding the main grip 16 is less covered by the right hand, which is the writing hand holding the auxiliary grip 17, and gyration of the right shoulder is suppressed. This makes the right shoulder tend to rise up, so hook ball occurs more easily. Such a club can therefore help to correct the swing of players who tend to play a slice ball.

By slightly adjusting the positional relation between the main grip 16 and auxiliary grip 17 in this way, not only can the extent to which the wrist of the right hand is restrained be adjusted, but also, the degree of gyration of the shoulder on the writing hand side and the extent to which the shoulder rises up on the writing hand side may be adjusted. Depending on the adjustment, the player may tend to produce either a slice ball or a hook ball during his swing. Effective use may be made if the position of the auxiliary grip 17 relative to the main grip 16 is adjusted according to the player's preference.

Next, another embodiment of this invention will be described with reference to FIGS. 7A, 7B, 8A and 8B. According to this embodiment, an auxiliary shaft 18 to which the auxiliary grip 17 is attached, is joined to the shaft 10 by a pair of join plates 41, 42. The upper plate 41 joins the shaft 10 and auxiliary shaft 18 by pins 43. The lower join plate 42 joins the shaft 10 and auxiliary shaft 18 by pins 44.

Figure 7:
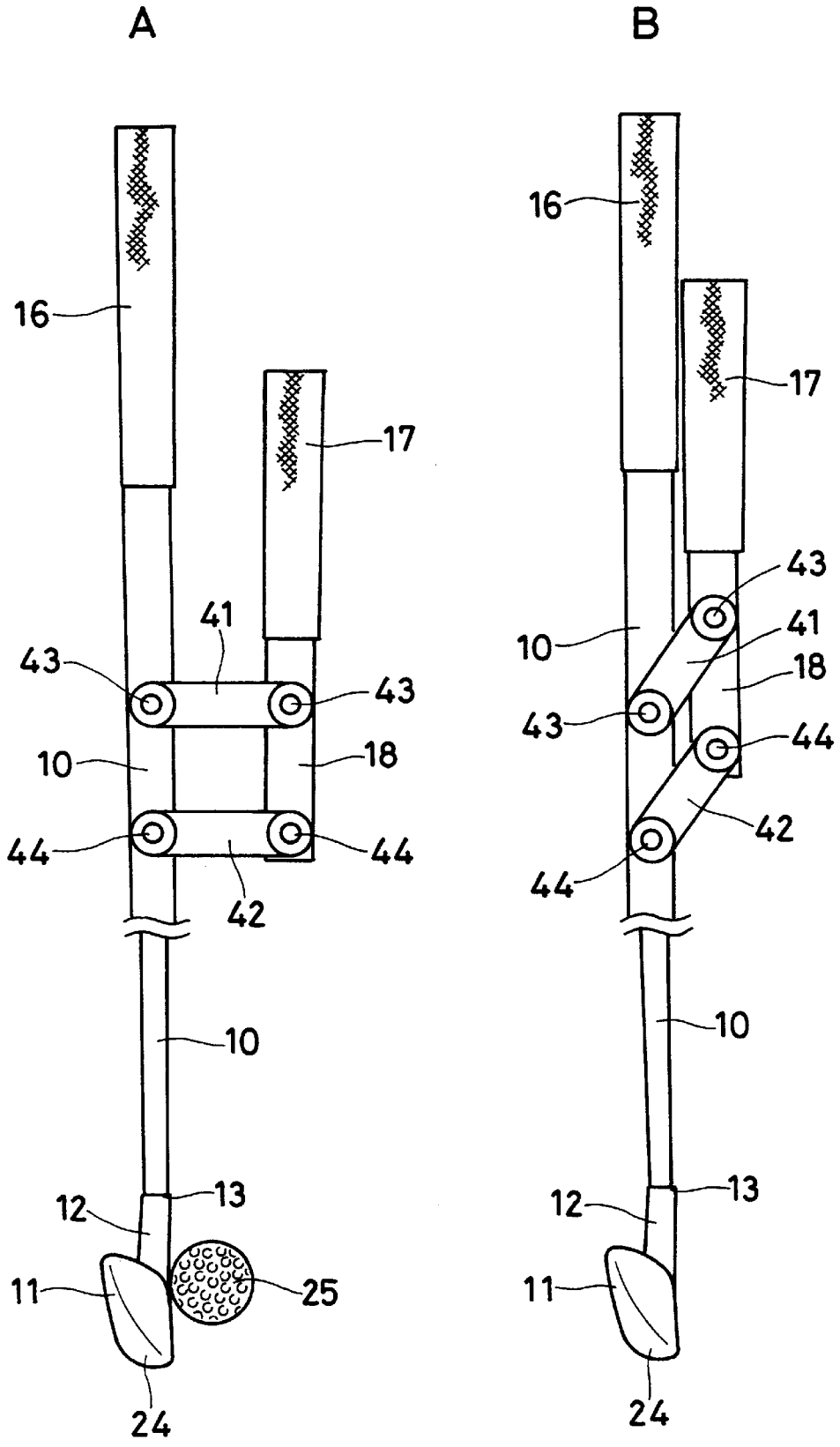
FIGS. 7A and 7B are front views of a golf club when in use and when in storage.
Figure 8:
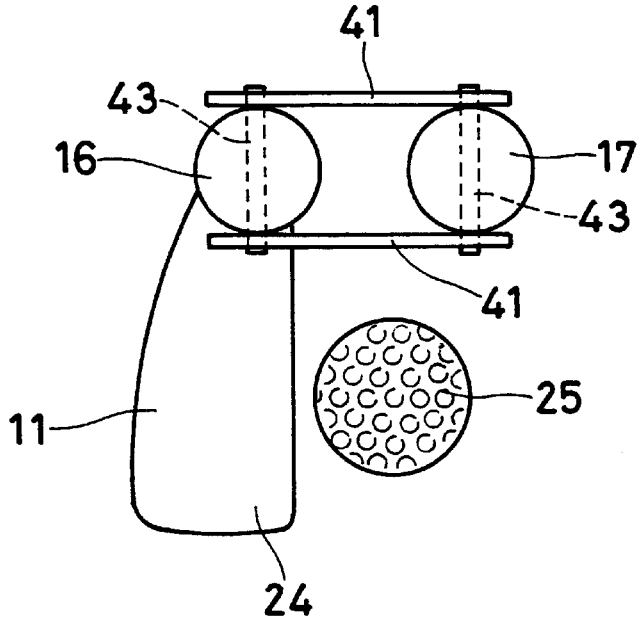
FIGS. 8A and 8B are plan views of a golf club shown in FIGS. 7A and 7B use and in storage.
Figure 8:
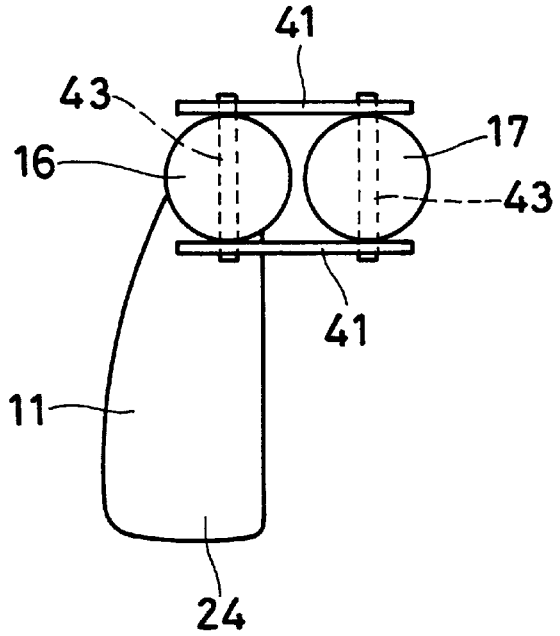

According to this construction, the join plates 41, 42 may be rotated so that they are effectively perpendicular to the shaft 10 and auxiliary shaft 18 as shown in FIG. 7A and FIG. 8A, thereby bringing the auxiliary grip 17 into a position separated from the main grip 16 in which it is to be used. On the other hand, when not in use, the join plates 41, 42 may be rotated so that the auxiliary grip 17 is brought in contact with the side of the main grip 16 and folded away as shown in FIG. 7B and FIG. 8B. In this way, the club does not take up excessive space when not in use, and a predetermined number of golf clubs can be stored correctly in a golf bag.

Figure 9:
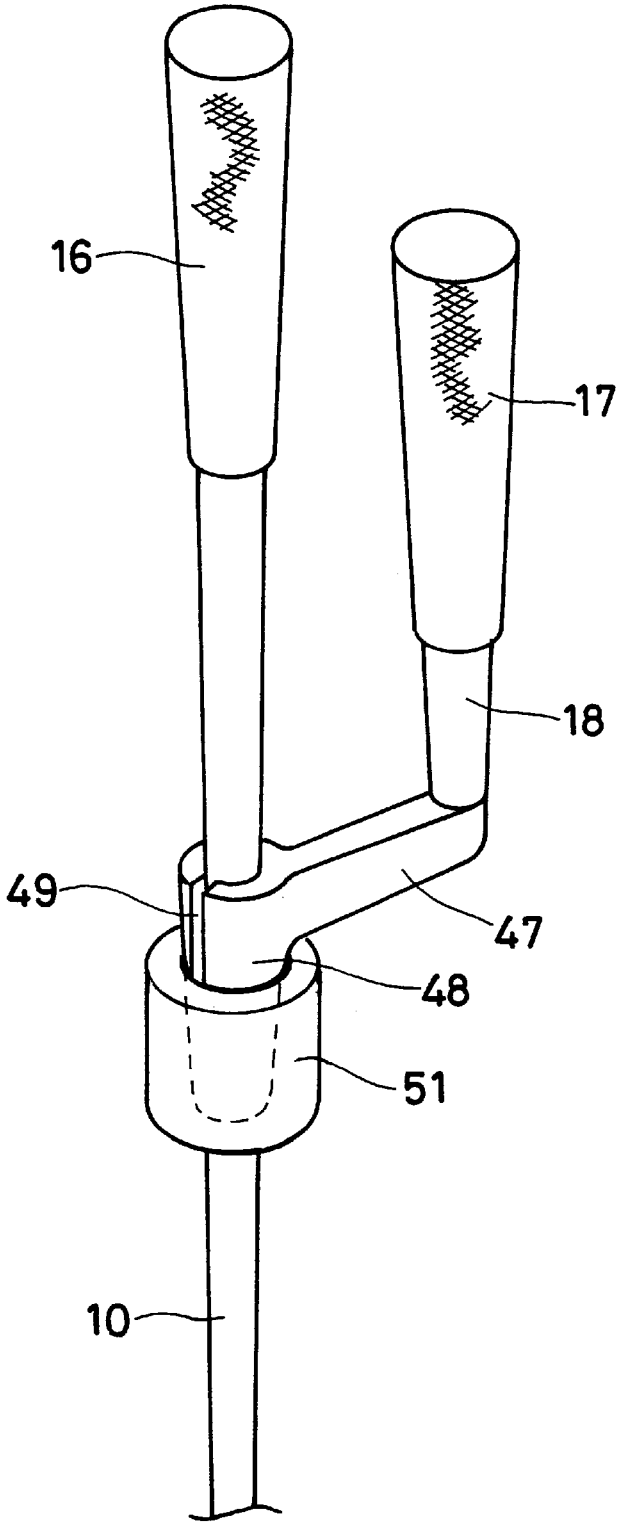
FIG. 9 is a perspective view of the essential parts of a golf club.
Figure 10:
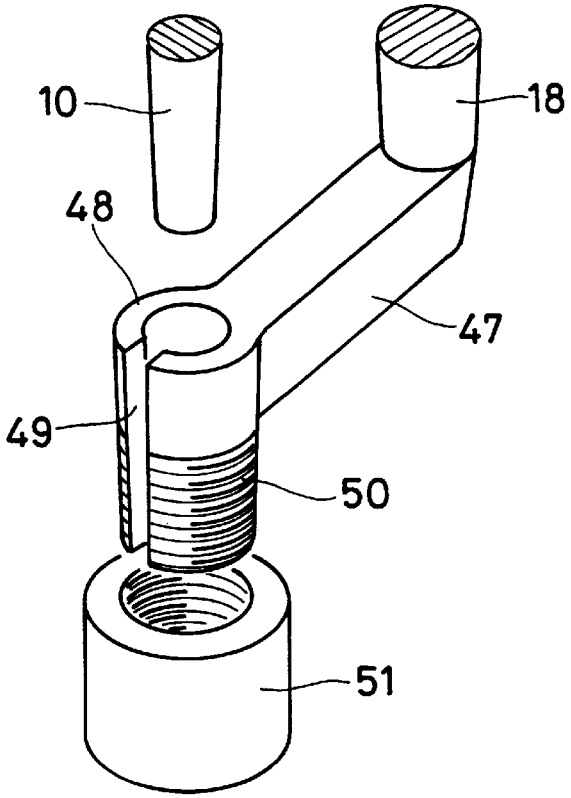
FIG. 10 is a perspective view of component parts showing the fitting of an auxiliary grip.
Figure 11:
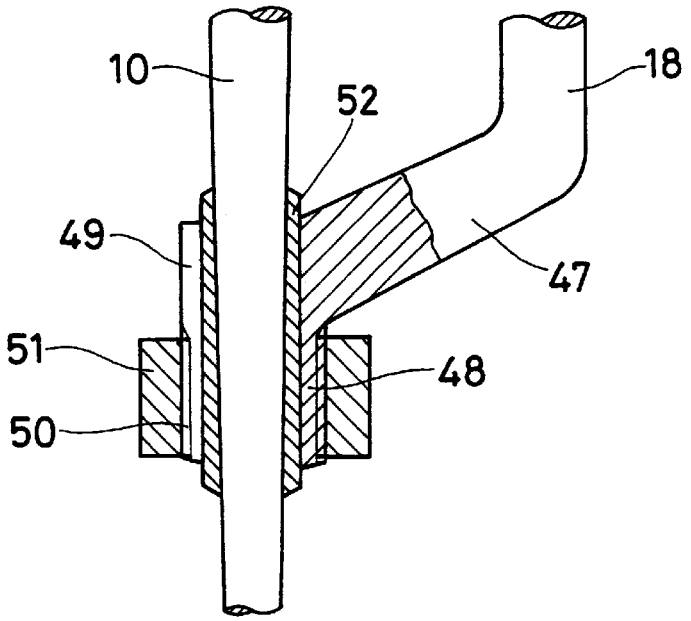
FIG. 11 is a longitudinal section through the essential parts of the component parts shown in FIG. 10.

Next, FIG. 9 to FIG. 11 show another embodiment of this invention. According to this embodiment, the auxiliary grip 17 is detachably fitted to the main shaft 10. Specifically, a connecting arm 47 is integrally connected to the auxiliary shaft 18 provided with the auxiliary grip 17, and a sleeve 48 is fitted to the end of this connecting arm 47. A slit 49 is provided in the sleeve 48 at a predetermined position in a circumferential direction of the sleeve.

To fix this connecting arm 47 on the shaft 10, the sleeve 48 is provided with a male screw 50 and a lock nut 51 comprising a female screw which screws onto the male screw 50. If necessary, an auxiliary sleeve 52 is first attached at the connecting point of the shaft 10 so as to increase the strength of the join.

When the connecting arm 47 is to be joined to the shaft 10, the lock nut 51 is first slid over the shaft 10 from the main grip 16. The sleeve 48 of the connecting arm 47 is then joined to the shaft 10 using the slit 49, the part of the shaft 10 having a small diameter near its tip being guided into the sleeve 48 through the slit 49. After sliding the sleeve 48 over the auxiliary sleeve 52 by moving it towards the main grip 16 along the shaft 10, the female screw of the lock nut 51 may be screwed onto the male screw 50 of the sleeve 48. The sleeve 48 is thereby tightened by the lock nut 51 and fixed on the shaft 10.

According to this construction, the auxiliary grip 17 may be detachably fitted to an ordinary golf club. The club may therefore be used in the usual way, or the auxiliary grip 17 may be fitted and a swing performed with the wrist of the right hand immobilized. In particular, when the auxiliary grip 17 is fitted and the wrist of the right hand is restrained, errors in the swing are appropriately corrected, so the auxiliary grip 17 may desirably be fitted when practice on golf using the club.

Having described specific embodiments of this invention with reference to the accompanying drawings, it is to be understood that the invention is not limited to those precise embodiments, and that various changes and modifications may be made by one skilled in the art without departing from the scope or spirit of the invention as described in the appended claims.

What is claimed is:

1. A method of correction of a golf swing, comprising:

holding a main grip formed at an end portion of a shaft of a golf club by a hand opposite to a writing hand of a user, holding an auxiliary grip attached to a middle of the shaft by the writing hand of the user, said auxiliary grip being located near and substantially parallel to the main grip and being disposed at a side ahead of the main grip in a swinging direction of the golf club to be spaced from the main grip for a predetermined space so that when the main and auxiliary grips are grasped by left and right hands, backs of the left and right hands contact each other between the main and auxiliary grips to restrain a wrist of the writing hand by the back of the hand opposite to the writing hand, and swinging the shaft while holding the main and auxiliary grips by the left and right hands.

2. A method of correction of a golf swing according to claim 1, wherein in said step of holding the auxiliary grip, said auxiliary grip is located lower than the main grip in an axial direction of the shaft such that a distance between upper ends of the auxiliary grip and the main grip is about 12–15 cm.

3. A method of correction of a golf swing according to claim 2, wherein in said step of holding the auxiliary grip, the space between the auxiliary grip and the main grip is about 1.5 to 2 times greater than a diameter of one of the auxiliary grip and the main grip.

4. A method of correction of a golf swing according to claim 3, wherein in said step of holding the auxiliary grip, said auxiliary grip is fixed to the main grip at right angles relative to a lower edge of a front surface of a head, and the swinging of the shaft is made along a plane between the main and auxiliary grips.

5. A method of correction of a golf swing according to claim 3, wherein in said step of holding the auxiliary grip, said auxiliary grip is fixed to the main grip at an acute angle relative to a lower edge of a front surface of a head.

6. A method of correction of a golf swing according to claim 3, wherein in said step of holding the auxiliary grip, said auxiliary grip is fixed to the main grip at an obtuse angle relative to a lower edge of a front surface of a head.

* * * * *